US007128701B1

(12) United States Patent
Ketcham

(10) Patent No.: US 7,128,701 B1
(45) Date of Patent: Oct. 31, 2006

(54) KNEE-CHEST ROWING BENCH

(76) Inventor: Jon M. Ketcham, 947 C St., Meadville, PA (US) 16335

( * ) Notice: Subject to any disclaimer, the term of this patent is extended or adjusted under 35 U.S.C. 154(b) by 0 days.

(21) Appl. No.: 10/455,841

(22) Filed: Jun. 6, 2003

(51) Int. Cl.
*A63B 26/00* (2006.01)

(52) U.S. Cl. ..... 482/142; 482/148

(58) Field of Classification Search ..... 482/142, 482/148, 907, 91; D21/676, 686, 690, 622
See application file for complete search history.

(56) References Cited

U.S. PATENT DOCUMENTS 4,625,962 A * 12/1986 Street ..... 482/116
5,169,363 A * 12/1992 Campanaro et al. ..... 482/96
5,971,485 A * 10/1999 Clark ..... 297/423.12
6,065,808 A * 5/2000 Tinsley ..... 297/423.11
6,149,556 A * 11/2000 Jordan ..... 482/104
6,543,853 B1 * 4/2003 Splane, Jr. ..... 297/423.12
6,726,607 B1 * 4/2004 Ihli ..... 482/127
2002/0002104 A1 * 1/2002 Panatta ..... 482/93
2004/0070253 A1 * 4/2004 Murphy et al. ..... 297/423.11

* cited by examiner

*Primary Examiner*—Lori Amerson
(74) *Attorney, Agent, or Firm*—Jonathan M. D'Silva; MacDonald, Illig, Jones & Britton LLP

(57) ABSTRACT

A kneeling bench and a head rest with a face opening afford a user a way to be comfortably situated in a face down position to perform rowing motions with free weights or weight stacks. The lateral distance between the two bench elements can be adjusted as can the vertical distance to accommodate different sized users. In addition the angle of the head rest is adjustable between angles of 25° and 35° from the horizontal.

21 Claims, 1 Drawing Sheet

KNEE-CHEST ROWING BENCH

This invention was disclosed in Disclosure Document No. 514,906 filed Jul. 15, 2002.

BACKGROUND AND SUMMARY OF THE INVENTION

The present invention is directed to the field of exercise devices. More particularly, the present invention is directed to a bench which supports the user's weight via a kneeling bench and a headrest leaving a zone from the mid-sternum to the knees open to permit a rowing arm motion.

The exercise equipment industry has mushroomed in the last 10 years. In the same time period, health clubs have grown in numbers and membership. The equipment used in health clubs is typically complex and expensive. Home gymnasiums, while providing numerous exercise options, are often complicated and difficult to use. Our lives, already complicated by work and family, cry out for simplicity to provide relief in the area of exercise.

The knee-chest rowing bench of the present invention provides a simplicity that is elegant, providing a face-downward support that comfortably supports the user's weight while permitting a significant range of motion for both arms simultaneously or, each arm individually. The user can use the bench with free weights such as barbells and dumbbells or with weight stacks employing cables and pulleys. The bench of the present invention is designed to provide the benefits of the barbell bent over rowing without the risks. Bent over rows are very effective exercise for the upper back but a dangerously strenuous exercise for the lower back.

Other attempts at providing a supported-type of bent-over row unit have typically relied on a long-axis support (i.e., a padded board) which runs continuously from episternal notch down to the umbilicus (navel) or lower. However, this type of support creates two problems: first, it interferes with breathing due to compressing the rib cage and abdomen against the board. Second, the support board acts as an obstacle or barrier since, in this exercise, the barbell is meant to be pulled into a zone ranging from just inferior to the nipple line (imaginary horizontal line connecting both nipples) down to the umbilicus. In this instance, the support board acts to decrease the effective range of motion (ROM).

One arm dumbbell rows are sometimes performed as a substitute for barbell bent-over rows. However, this exercise is considered secondary, at best, in terms of effectiveness. Furthermore, the stabilizing arm, which is kept straight, tends to bear an increased amount of stress to the shoulder and rotator cuff musculature.

The knee-chest rowing bench of the present invention includes plural support surfaces including a kneeling platform at a first level for supporting a majority of the user's body weight in a kneeling position at a height in the range from one foot to two feet from a floor; a headrest for at a second level above said first level for supporting the user's head in a face down orientation; the plural support surfaces supporting the user's full weight leaving unencumbered a zone at least between the user's mid-sternum and navel to facilitate arm motion and breathing at a height sufficient to permit the user's arms to swing in a fully extended position without contacting the floor.

The exercise bench preferably has means to adjust both the horizontal and vertical distances between the headrest and the kneeling bench, in order to comfortably accommodate individual body sizes and shapes. The headrest preferably has an opening in its upper supporting surface to comfortably accommodate the user's face. The angularity of the headrest is preferably adjustable between a range of 25° and 35°, again, in order to accommodate personal preference and afford maximum comfort. A pair of, preferably, vertically oriented handles are positioned either side of the headrest to provide the user balance while doing rowing exercises with the opposite hand.

The knee-chest rowing bench of the present invention is geared to the serious weight trainee, be it a school athlete, body builder, fitness enthusiast or dedicated home trainee.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
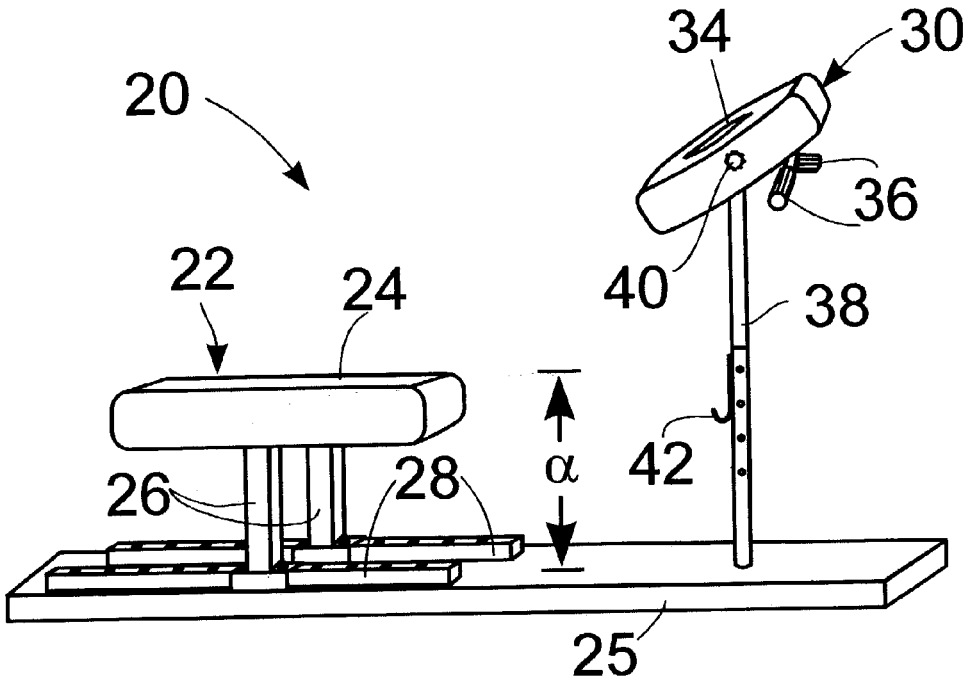
FIG. 1 is a side view of a first embodiment of the exercise bench of the present invention.
Figure 2:
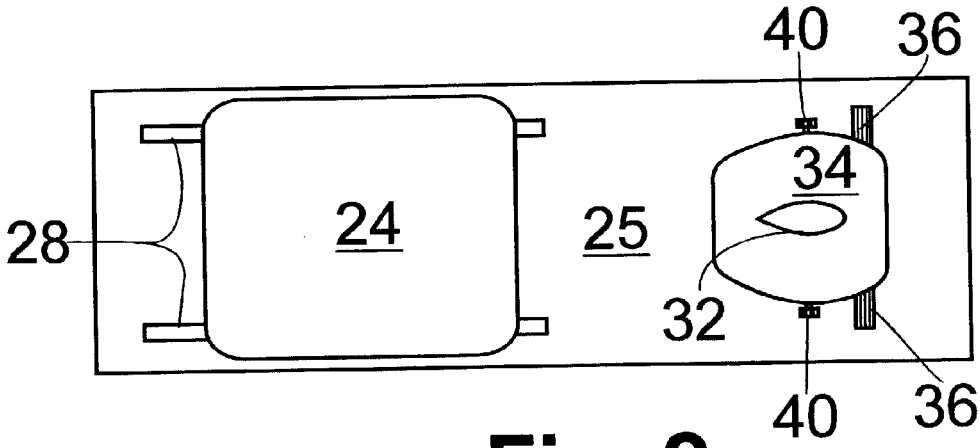
FIG. 2 is a top view of the first embodiment.

A first embodiment of the knee-chest rowing bench of the present invention is depicted in FIGS. 1 and 2 generally at 20. Exercise bench 20 of the present invention has two main components: kneeling bench 22 and head rest 30. Kneeling bench 20 supports the majority of the user's body weight in kneeling position on support pad 24 via legs 26 a distance $\alpha$ from the nearest floor, in this case, support pallet 25. The distance $\alpha$ is preferably in the range of between one foot and two feet from the floor with $\alpha$ most preferably being 18". This distance, coupled with the upward body slant afforded by the position of head rest 30, will enable the user to freely swing her/his arm beneath her/him without contacting the floor 25. While knee-chest rowing bench 20 is shown anchored to a support pallet, in a health club environment, elements 22 and 30 could obviously be mounted directly to the floor. Legs 26 are shown mounted on tracks 28 to permit toward and away movement relative to the head rest 30. This enables bench 20 to comfortably accommodate different sized body frames.

Head rest 30 has a face opening 32 to permit the user to support her/his head on the pillow 34 without smashing her/his nose. This provides head/neck support in neutral position without any rotation or extension of the cervical spine. In addition, opening 32 will permit some visibility of the hand motion during the exercise. It is contemplated that if bench 20 is employed for home use, the user will most typically use hand weights to swing to-and-fro in a sweeping motion beneath her/his suspended frame. Both arms can be swung simultaneously, while using a barbell or pair of dumbbells. By grasping handle 36 on the offside for balance while alternately working the arm/shoulder muscles of first the left side and then the right, dumbbell rows could also be performed one arm at a time. While the handles 36 have been shown as extending laterally, for ease of depiction, they will more preferably, have a vertically extending, graspable portion to enhance stability of the user. A pair of racks 42 (one shown) are positioned on the front of the support stand 38 to accommodate a barbell (not shown). It will be understood that the racks 42 could be free standing supporting the barbell in a similar position. The user may grasp the barbell with both hands and pull it upwardly to contact her/his chest in a rowing motion. Since the knee-chest rowing bench of the present invention leaves the user's torso unencumbered, this rowing exercise, as well as a number of others, is facilitated.

Two additional adjustments are provided; first, the height of support stand 38 can be adjusted vertically, again, to accommodate various builds of users. The adjustment is shown as a pin in aligned holes of telescoping tubes, although it will be appreciated that other adjustment means could be used. Second, the tilt angle of the head rest 30 can be adjusted, preferably within a range of 25° and 35° from horizontal, by loosening then tightening knurled knobs 40 to lock head rest 30 at the desired angular position, although it will be appreciated that other adjustment means could be used.

By adjusting the distance between the kneeling bench 22 and head rest 30, the height of head rest 30 and the angle of pillow 34, the exercise bench 20 of the present invention can be configured to comfortably accommodate any user. The handles 36 afford a means of balance for the offhand side while the user uses free weights or weight stacks to exercise the opposite arm/shoulder muscle group. The knee-chest rowing bench 20 of the present invention provides a simple, effective bench permitting upper body exercises, particularly barbell bent-over rows, 2-arm dumbbell rows, and 1-arm dumbbell rows. These exercises can be performed by a user who is comfortably positioned without a) compromising lower back or shoulder safety (as free standing versions do) and b) compromising breathing and range of motion (as supported versions do).

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. An exercise bench with plural support surfaces for supporting a user for upper body exercise, said plural support surfaces comprising:

(a) a kneeling platform at a first level for supporting a majority of the user's body weight in a kneeling position at a height in the range from one foot to two feet from a floor;

(b) a headrest at a second level spaced by a first vertical distance above said first level and by a second horizontal distance for supporting the user's head in a face down orientation, said headrest including an opening in said headrest sized to comfortably accommodate a user's face;

said plural support surfaces being spaced horizontally and vertically to support the user's full weight in a face down, kneeling position, her/his weight being distributed between the user's knees and portions of her/his face leaving unencumbered and unsupported a zone at least between the user's mid-sternum and navel to facilitate arm motion and breathing at a height sufficient to permit the user's arms to swing in a fully extended position without contacting the floor.

2. The exercise bench of claim 1 wherein said plural support surfaces are spaced horizontally and vertically to provide a zone unencumbered and unsupported by said support surfaces extending at least between the user's mid-sternum and the user's knees.

3. The exercise bench of claim 1 further comprising means for adjusting said second horizontal distance between said kneeling platform and said headrest.

4. The exercise bench of claim 1 further comprising means for adjusting said second level vertically to alter said first vertical distance above said first level of said kneeling platform to accommodate a user's body size and provide maximum comfort.

5. The exercise bench of claim 1 wherein said opening is provided by a space formed between two portions of a split headrest.

6. The exercise bench of claim 1 further comprising means to position said headrest at an angle to horizontal in a range between 25° and 35°.

7. The exercise bench of claim 6 wherein said angle to the horizontal is most preferably 30°.

8. The exercise bench of claim 6 further comprising means for adjusting said headrest throughout said range.

9. The exercise bench of claim 1 further comprising a pair of handles positioned on either side of said headrest to facilitate one-armed exercises by grasping an off-sided handle with the user's opposing band.

10. The exercise bench of claim 1 further comprising support rack means for suspending a barbell therefrom.

11. The exercise bench of claim 3 wherein said means for adjusting said second horizontal distance comprises rail means upon which one of said plural support surfaces can slide in a horizontal direction.

12. An exercise bench with plural support surfaces for supporting a user for upper body exercise, said plural support surfaces comprising:

a first support surface comprising a kneeling platform at a first level at a height in the range from one foot to two feet from a floor;

a second support surface comprising a headrest at a second level, said second support surface including an opening in said headrest sized to accommodate a user's face; and said second level spaced at a vertical distance above said first level and a horizontal distance from said first level such that said first support surface supports a majority of the user's body weight in a kneeling position and said second support surface supports the user's upper body in a face down orientation by contacting the user's body at a position on the user's body that includes at least the user's mid-sternum and above, said first and second support surfaces spaced to leave unencumbered and unsupported a zone at least between the first and second support surfaces to permit the user to make rowing arm motions beneath the user's suspended frame using a barbell, a dumbbell, or a pair of dumbbells.

13. The exercise bench of claim 12 further comprising a vertical adjuster for adjusting said vertical distance between said first support surface and said second support surface.

14. The exercise bench of claim 12 further comprising a horizontal adjuster for adjusting said horizontal distance between said first support surface and said second support surface.

15. The exercise bench of claim 12 further comprising a horizontal adjuster for adjusting said horizontal distance between said first support surface and said second support surface wherein said horizontal adjuster comprises a rail upon which one of said plural support surfaces can slide in a horizontal direction.

16. The exercise bench of claim 12 wherein said opening is provided by a space formed between two portions of a split headrest.

17. The exercise bench or claim 12 further comprising means to position said second support surface at an angle to horizontal in a range between about 25° and about 35°.

18. The exercise bench of claim 12 wherein said second support surface is at an angle to the horizontal of about 30°.

19. The exercise bench of claim 12 further comprising a pair of handles positioned under said second support surface on either side of said second support surface.

20. The exercise bench of claim 12 further comprising support rack means for suspending a barbell therefrom.

21. An exercise bench with plural support surfaces for supporting a user for upper body exercise, said plural support surfaces comprising:

a first support surface comprising a kneeling platform at a first level at a height in the range from one foot to two feet from a floor;

a second support surface comprising a headrest at a second level, said second support surface including an opening in said headrest sized to accommodate a user's face;

said second level spaced at a vertical distance above said first level and a horizontal distance from said first level such that said first support surface supports a majority of the user's body weight in a kneeling position and said second support surface supports the user's upper body in a face down orientation by contacting the user's body at a position on the user's body that includes at least the user's mid-sternum and above, said first and second support surfaces spaced to leave unencumbered and unsupported a zone at least between the first and second support surfaces to permit the user to make rowing arm motions beneath the user's suspended frame using a barbell, a dumbbell, or a pair of dumbbells;

a vertical adjuster for adjusting said vertical distance between said first support surface and said second support surface;

a horizontal adjuster for adjusting said horizontal distance between said first support surface and said second support surface;

means to position said second support surface at an angle to horizontal in a range between about 25° and about 35°;

a pair of handles positioned under said second support surface on either side of said second support surface; and support rack means for suspending a barbell therefrom.

* * * * *